US005935767A

United States Patent [19]

Becher et al.

[11] Patent Number: 5,935,767

[45] Date of Patent: Aug. 10, 1999

[54] PROCESS OF PRODUCING COLOR NEGATIVE IMAGE AT SHORTENED DEVELOPMENT TIMES

[75] Inventors: John H. Becher, Webster; Roger A. Bryant, Rochester, both of N.Y.

[73] Assignee: Eastman Kodak Company, Rochester, N.Y.

[21] Appl. No.: 09/015,720

[22] Filed: Jan. 29, 1998

[51] Int. Cl.[6] ..... G03C 7/34

[52] U.S. Cl. ..... 430/385; 430/384

[58] Field of Search ..... 430/384, 385

[56] References Cited

U.S. PATENT DOCUMENTS

| | | | |
|---|---|---|---|
| 3,488,193 | 1/1970 | Vanden Eynde et al. | 430/385 |
| 4,184,876 | 1/1980 | Eeles et al. | 430/505 |
| 4,937,178 | 6/1990 | Koboshi et al. | 430/375 |
| 4,957,853 | 9/1990 | Kobayashi et al. | 430/384 |
| 5,215,872 | 6/1993 | Goto et al. | 430/384 |
| 5,380,625 | 1/1995 | Mihayashi et al. | 430/384 |

OTHER PUBLICATIONS

Research Disclosure, vol. 389, Sep. 1996, Item 38957, IE; X.B&C.

*Primary Examiner*—Hoa Van Le
*Attorney, Agent, or Firm*—Carl O. Thomas

[57] ABSTRACT

Increased speed of the red record is realized when a color negative film is developed in 2 minutes or less and contains a fast and slow pair of red recording emulsion layers, the fast layer containing at a concentration of at least 0.1 mole per silver mole a colorless cyan dye-forming 2-(alkoxyarylcarbamoyl)-1-naphthol coupler.

12 Claims, No Drawings

PROCESS OF PRODUCING COLOR NEGATIVE IMAGE AT SHORTENED DEVELOPMENT TIMES

FIELD OF THE INVENTION

The invention relates to the photographic processing of color negative films that contain radiation-sensitive silver halide emulsions and form yellow, magenta and cyan dye images.

DEFINITIONS

All references to silver halide grains and emulsions containing two or more halides name the halides in order of ascending concentrations.

The term "emulsion layer unit" refers an emulsion layer or a plurality of contiguous emulsion layers that all record in the same one of the blue, green and red regions of the spectrum.

In referring to grains, the term "ECD" indicates mean equivalent circular diameter and, in describing tabular grains, "t" indicates mean tabular grain thickness.

All coating coverages are in units of $g/m^2$, except as otherwise stated. Silver halide coating coverages are based on silver.

The term "E" is used to indicate exposure in lux-seconds.

In referring to processing times, primes (') are used to indicate minutes and double primes (") are used to indicate seconds.

Imaging speeds were measured at 0.15 above minimum density for each color record.

*Research Disclosure* is published by Kenneth Mason Publications, Ltd., Dudley House, 12 North St., Emsworth, Hampshire P010 7DQ, England.

BACKGROUND

In a simple construction, a conventional color negative film intended for in-camera exposure typically takes the following form:

| CNF-I |
|---|
| OC |
| BRELU |
| YFL |
| GRELU |
| IL |
| RRELU |
| AHL |
| TRANSPARENT FILM SUPPORT |

On the transparent film support are coated in the order shown, a series of processing solution penetrable hydrophilic colloid layers: antihalation layer AHL, a red recording emulsion layer unit RRELU containing a red sensitized silver iodobromide (AgIBr) emulsion and a colorless cyan dye-forming coupler, an interlayer IL containing an oxidized developing agent scavenger, a green recording emulsion layer unit GRELU containing a green sensitized AgIBr emulsion and a colorless magenta dye-forming coupler, a yellow filter layer YFL containing a Carey Lea silver or a processing solution decolorizable yellow filter dye and an oxidized developing agent scavenger, a blue recording emulsion layer unit BRELU containing blue sensitive (optionally blue sensitized) AgIBr emulsion and a colorless yellow dye-forming coupler, and a transparent protective overcoat OC. In the simplest possible construction capable of producing a color negative image, all of the hydrophilic colloid layers, except BRELU, GRELU and RRELU can be omitted. In the overwhelming majority of practical applications all of the layers of CNF-I described above are employed and, most commonly, many additional addenda are incorporated for performance enhancement. For example, comparatively small amounts of colored counterparts of one or more of the colorless yellow, magenta and cyan dye-forming couplers are commonly employed as masking couplers.

Yellow, magenta and cyan dye-forming couplers can take varied forms. Colorless dye-forming couplers are relied upon for forming yellow, magenta and cyan dye images, as illustrated by *Research Disclosure*, Item 38957, X. Dye image formers and modifiers, B. Image-dye-forming couplers and C. Image dye modifiers. Specific illustrations of colorless cyan dye-forming 2-(alkoxyarylcarbamoyl)-1-naphthol couplers are provided by Vanden Eynde et al U.S. Pat. No. 3,488,193 and Kobayashi et al U.S. Pat. No. 4,957,853.

In their simplest possible construction each of BRELU, GRELU and RRELU contain a single AgIBr emulsion. However, as elaborated on in *Research Disclosure*, Vol. 389, September 1996, Item 38957, I. Emulsion grains and their preparation, E. Blends, layers and performance categories, paragraph (7), when a fast emulsion layer is coated over a slow emulsion layer, an increase in imaging speed without an offsetting increase in granularity can be realized. Therefore, it is common practice to double-coat or triple-coat by splitting the AgIBr emulsions in BRELU, GRELU and RRELU into two or three separate emulsion layers differing in imaging speed.

A typical double-coated color negative film construction can take the following form:

| CNF-II |
|---|
| OC |
| BRELU Fast blue recording emulsion layer |
| Slow blue recording emulsion layer |
| YFL |
| GRELU Fast green recording emulsion layer |
| Slow green recording emulsion layer |
| IL |
| RRELU Fast red recording emulsion layer |
| Slow red recording emulsion layer |
| AHL |
| TRANSPARENT FILM SUPPORT |

It is also common practice to space physically the fast and slow emulsion layers that record blue, green or red to minimize the number of slow emulsion layers that must be penetrated by exposing radiation to reach the fast green and/or fast red emulsion layers. Two common constructions are illustrated by the following:

| CNF-III |
|---|
| OC |
| Fast BRELU |
| IL |
| Fast GRELU |
| IL |
| Fast RRELU |
| IL |
| Slow BRELU |
| YFL |
| Slow GRELU |
| IL |
| Slow RRELU |
| AHL |
| TRANSPARENT FILM SUPPORT |

and

| CNF-IV |
|---|
| OC |
| BRELU |
| YFL |
| Fast GRELU |
| IL |
| Fast RRELU |
| IL |
| Slow GRELU |
| IL |
| SIow RRELU |
| AHL |
| TRANSPARENT FILM SUPPORT |

The Kodak Flexicolor™ C-41 process is commonly employed for processing imagewise exposed color negative films. Since minor adjustments of the C-41 process are undertaken from time to time, the following detailed description is provided:

| | | |
|---|---|---|
| Develop | 3'15" Developer | 37.8° C. |
| Bleach | 4' Bleach | 37.8° C. |
| Wash | 3' | 35.5° C. |
| Fix | 4' Fixer | 37.8° C. |
| Wash | 3' | 35.5° C. |
| Rinse 1' | Rinse | 37.8° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |
| N-(4-amino-3-methylphenyl)-N-ethyl-2-aminoethanol | 4.52 g |
| Water to make | 1.0 L |
| pH @ 26.7° C. 10.00 +/− 0.05 | |

Bleach

| | |
|---|---|
| Water | 500.0 mL |
| 1,3-Propylenediamine tetra-aceticacid | 37.4 g |
| 57% Ammonium hydroxide | 70.0 mL |
| Acetic acid | 80.0 mL |
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |

Fix

| | |
|---|---|
| Water | 500.0 mL |
| Ammonium Thiosulfate (58% solution) | 214.0 g |
| (Ethylenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/− 0.15 | |

Rinse

| | |
|---|---|
| Water | 900.0 mL |
| 0.5% Aqueous p-tertiary-octyl-(α-phenoxypolyethyl)alcohol | 3.0 mL |
| Water to make | 1.0 L |

Koboshi et al U.S. Pat. No. 4,937,178 discloses a process of producing a color negative image having a magenta dye density equal to at least 2 during a development time of not more than 3 minutes employing an imagewise exposed color negative film that produces a magenta dye density of less than 2 during development under conditions essentially similar to the Flexicolor™ C-41 process described above. To get higher magenta dye densities in a shorter development time "unconventionally active conditions" are employed. Reduced graininess is stated to be an unexpected advantage of unknown origin. Numerous specific preferred selections within the generic process are stated to be separate inventions. A listing of 99 colorless cyan dye-forming couplers and 38 colored cyan dye-forming couplers taught to be useful by Koboshi et al includes only phenolic cyan dye-forming couplers, while in the Examples 1-hydroxy-4-(β-methoxyethylaminocarbonylmethoxy)-N-[δ-(2,4-di-t-amylphenoxy)butyl]-2-naphthamide is employed as a colorless coupler in only "standard" (comparison) color negative films, although lesser amounts of the colored coupler 1-hydroxy-4-[4-(1-hydroxy-8-acetamido-3,6-disulfo-2-naphthylazophenoxy]-N-[δ-(2,4-di-t-amylphenoxy)butyl]- 2-naphthamide are employed throughout the Examples. From this it is apparent that Koboshi et al did not consider colorless naphthol cyan dye-forming couplers to be advantageous in the process disclosed.

SUMMARY OF THE INVENTION

A process of producing a color negative image comprised of (1) developing an imagewise exposed photographic element to create a silver image and yellow, magenta or cyan dye images, (2) bleaching the silver image, and (3) fixing to remove silver halide, the imagewise exposed photographic element being comprised of a transparent film support and, coated on the support, at least one blue recording silver iodobromide emulsion layer containing yellow dye-forming coupler and located to receive exposing radiation prior to all green and red recording emulsion layers, a yellow filter layer located to receive exposing radiation from the blue recording layer unit, at least two green recording silver iodobromide emulsion layers containing magenta dye-forming coupler and located to receive exposing radiation from the yellow filter layer, including a fast green recording emulsion layer and at least one slow green recording emulsion layer, the fast green recording emulsion layer being located to receive exposing radiation directly from the yellow filter layer, at least two red recording silver iodobromide emulsion layers containing cyan dye-forming coupler, including a fast red recording emulsion layer and at least one slow red recording emulsion layer, the fast red recording emulsion layer being located to receive exposing radiation after at least the fast emulsion layer of the green recording emulsion layers and to be the first red recording emulsion layer to receive exposing radiation, wherein, development is undertaken in 2 minutes or less and the fast red recording layer unit contains in a concentration of at least 0.1 mole per silver mole a colorless cyan dye-forming 2-(alkoxyphenylcarbamoyl)-1-naphthol coupler.

As demonstrated in the Examples below, when a colorless 2-(alkoxyphenylcarbamoyl)-1-naphthol cyan dye-forming coupler is substituted for a colorless phenolic cyan dye-forming coupler of the type disclosed by Koboshi et al, no significant increase in speed is observed at a development time of 3' 15". However, quite surprisingly, when the development time is reduced to two minutes or less, the 2-(alkoxyphenylcarbamoyl)-1-naphthol cyan dye-forming coupler produces a marked increase in speed.

DESCRIPTION OF PREFERRED EMBODIMENTS

The present invention is directed to a process for producing a color negative image comprised of (1) developing in 2 minutes or less an imagewise exposed color negative photographic element having the construction described below to create a silver image and yellow, magenta and cyan dye images, (2) bleaching the silver image, and (3) fixing to remove silver halide.

The color negative element includes at least two red recording silver iodobromide emulsion layers differing in speed and containing cyan dye-forming coupler. The fast red recording emulsion layer is located to receive exposing radiation prior to the remaining red recording emulsion layer or layers. The fast red recording emulsion layer contains in a concentration of at least 0.1 mole per silver mole a colorless cyan dye-forming 2-(alkoxyphenylcarbamoyl)-1-naphthol coupler.

Whereas colorless phenolic cyan dye-forming couplers are perhaps the most widely used couplers in color negative films and are taught by Koboshi et al to be the colorless cyan dye-forming couplers of choice for processing in less than 3 minutes, in direct comparisons with colorless phenolic cyan dye-forming couplers in fast red recording emulsions processed with development times of 2 minutes or less, colorless 2-(alkoxyphenylcarbamoyl)-1-naphthol couplers have been demonstrated to produce significantly higher imaging speeds.

In one general form the colorless 2-(alkoxyphenylcarbamoyl)-1-naphthol couplers contemplated for use in the practice of the invention satisfy the formula:

(I)

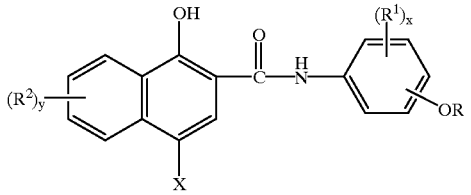

wherein

X, R, $R^1$, $R^2$ and $R^3$ are each free of a dye chromophore and contain less than 32 (preferably less than 22) carbon atoms, R represents a substituted or unsubstituted linear or branched chain alkyl group containing at least 6 carbon atoms, $R^1$ and $R^2$ each represents any convenient aromatic ring substituent, X is hydrogen or a coupling off group, and x and y are each an independent integer of from 0 to 4.

X represents a hydrogen atom or a group which can be released from the naphthyl ring upon a coupling reaction with an oxidized form of aromatic primary amine developing agent (i.e., a "coupling off" group). Examples of simple coupling off groups include a halogen atom; —COOM or —$SO_3M$ (where M represents hydrogen or a moiety capable of forming an acid salt, such as ammonium or an alkali metal); an aliphatic, aromatic or heterocyclic group joined through an oxy linkage; an aliphatic thio group; an aromatic thio group; an acyl oxy group; a carbonamido group; an aliphatic sulfonyloxy group; an aromatic sulfonyloxy group; an aliphatic thiocarbonylamino group; a carbamoyloxy group; or a nitrogen linked heterocyclic group.

It is appreciated that the coupling off group can take the form of a colorless photographically useful group (PUG) used to modify image characteristics. However, only rarely, if ever, does the optimum concentration for PUG releasing couplers reach the coupler concentrations required for imaging. Therefore, when release of a PUG is contemplated, a mixture of 2-(alkoxyphenylcarbamoyl)-1-naphthol couplers that do and do not release PUG's from the coupling off position are normally employed. Development accelerator releasing couplers (DARC's) are typically good reducing agents and often comprise a hydrazide group. Bleach accelerators capable of being released from a bleach accelerator releasing coupler (BARC's) often comprise the structure —S—L—X wherein L is a linking group and X is a hydrophilic group. For example, the hydrophilic group can be a carboxy, morpholino, hydroxyl, or substituted or unsubstituted amino group. Development inhibitor releasing couplers release development inhibitors directly (DIR's) or through one or more links or timing groups (DIAR's: development inhibitor anchimeric releasing). Further illustrations of BARC, DARC, DIR and DIAR coupling off groups are found in *Research Disclosure*, Item 38957, X. Dye image formers and modifiers, C. Image dye modifiers.

R represents a substituted or unsubstituted linear or branched chain alkyl group containing 6 or more carbon atoms, preferably 6 to 24 carbon atoms. Specific examples of alkyl group substituents include an alkenyl group, an alkynyl group, a cycloalkyl group, an aromatic group (e.g., a phenyl or naphthyl group), a heterocyclic group, a halogen atom, an aliphatic oxy group, an aromatic oxy group (e.g., phenoxy), a heterocyclic oxy group, an aliphatic thio group, an aromatic thio group, a heterocyclic thio group, a hydroxy group, a cyano group, an aliphatic sulfonyl group, an aromatic sulfonyl group, a heterocyclic sulfonyl group, an aliphatic sulfinyl group, a heterocyclic sulfonyl group, an aliphatic oxycarbonyl group, an acyloxy group, an acyl group, carbamoyl group, sulfamoyl group, a carbonamido group, a sulfonamido group, a ureido group, a sulfamoylamino group, an aliphatic oxycarbonylamino group, and a carbamoyloxy group.

In the above description, an aliphatic group represents a straight or branched chain or cyclic alkyl, alkenyl or alkynyl group which may be substituted; an aromatic group represents a substituted or unsubstituted monocyclic or fused ring aryl group (preferably containing 6 to 10 carbon atoms); and a heterocyclic group represents a substituted or unsubstituted 5- or 6-membered ring containing at least one N, S or O atom, with or without a fused heterocyclic or carbocyclic ring (preferably containing from 5 to 10 ring atoms).

Examples for substituents for the aliphatic group include an aryl group, an alkoxy group, an epoxy group, a carbonamido group, a halogen atom, a cyano group, —COOM, a hydroxy group, a sulfonamido group, a carbonyl (including aliphatic and aromatic) group, an acyl group, an acyloxy group, an alkoxycarbonyl group, an alkylsulfonyl group, and aryloxy group.

Examples for substituents for the aryl groups include an alkyl group, an alkoxy group, an epoxy group, a carbonamido group, a halogen atom, a cyano group, —COOM, a hydroxy group, a sulfonamido group, a carbonyl (including aliphatic and aromatic) group, an acyl group, an acyloxy group, an alkoxycarbonyl group, an alkylsulfonyl group, and aryloxy group.

Examples for substituents for the heterocyclic group include an alkyl group, an aryl group, an alkoxy group, an epoxy group, a carbonamido group, a halogen atom, a cyano group, —COOM, a hydroxy group, a sulfonamido group, a carbony (including aliphatic and aromatic) group, an acyl group, an acyloxy group, an alkoxycarbonyl group, an alkylsulfonyl group, and aryloxy group.

Examples of such an aliphatic group include a methyl group, ethyl group, a t-butyl group, cyclohexyl group, 2-ethylhexyl group, n-decyl group, n-dodecyl group, 2-hexyldecyl group, n-hexadecyl group, allyl group, propargyl group, benzyl group, octadecynyl group, trifluoromethyl group, carboxy methyl group, methoxyethyl group, dodecyloxy carbonyl methyl group, and 2-methyl sulfonyl ethyl group, Examples of an aromatic group include phenyl group, naphthyl group, p-tolyl group, 4-methoxyphenyl group, 2-acetamide phenyl group, and 4-t-octylphenyl group. Examples of such a heterocyclic group include 2-pyridyl group, 4-pyridyl group, 2-furyl group, 2-thienyl group, 8-quinolyl group, 1-phenyl-5-tetrazolyl group, 1-pyrazolyl group, 1-imidazolyl group, 2,4-dioxoimidazolidine-3-yl group, and benzotriazole-1-yl group.

OR can be attached to the phenyl ring in Formula (I) in the ortho, meta or para position. In a specifically preferred form OR is located in the ortho or 2-position of the phenyl ring—that is, adjacent the carbamoyl linkage.

$R^1$ can be hydrogen, halogen or can take any of the forms of R described above, except that there is no requirement that $R^1$ contain at least 6 carbon atoms. Thus, $R^1$ additionally includes lower alkyl ($C_{1-5}$) groups. $R^1$ preferably contains less than 22 carbon atoms.

$R^2$ can take any of the forms of —R, —OR or $R^1$, except that when $R^2$ takes the form of —R or —OR there is no requirement that $R^2$ contain at least 6 carbon atoms. Preferably $R^2$ contains less than 22 carbon atoms.

x and y can independently be any integer of from 0 to 4. It is usually preferred that x and y be chosen from the integers 0 or 1.

The colorless cyan dye-forming 2-(alkoxyphenylcarbamoyl)-1-naphthol couplers in a simple, preferred form are as shown in formula (I), with x and y both zero and —OR being located in 2-position of the phenyl ring with R being a hydrocarbon containing from 8 to 20 carbon atoms.

Colorless cyan dye-forming 2-(alkoxyphenylcarbamoyl)-1-naphthol couplers satisfying the requirements of the invention that do not contain PUG's in the coupling off position can be selected from among those disclosed by Vanden Eynde et al U.S. Pat. No. 3,488,193 and Kobayashi et al U.S. Pat. No. 4,957,853, the disclosures of which are here incorporated by reference. Colorless cyan dye-forming 2-(alkoxyphenylcarbamoyl)-1-naphthol couplers with PUG attachments are in the coupler teachings of *Research Disclosure*, Item 38957, X. Dye image formers and modifiers, C. Image dye modifiers, cited above.

The following are specific illustrations of colorless cyan dye-forming 2-(alkoxyphenylcarbamoyl)-1-naphthol couplers satisfying the requirements of the invention. CC-1 to CC-11 do not contain PUG's at the coupling off position, while CC-12 to the end of the listing illustrate couplers containing releasable PUG's.

CC-1

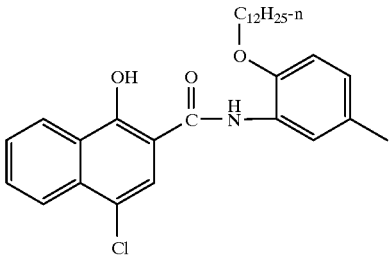

CC-2

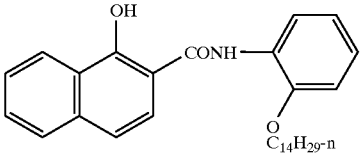

-continued

CC-3

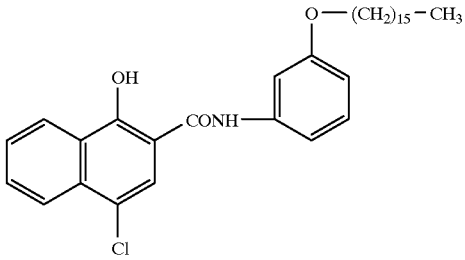

CC-4

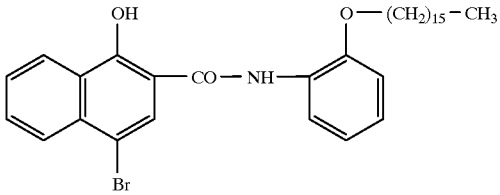

CC-5

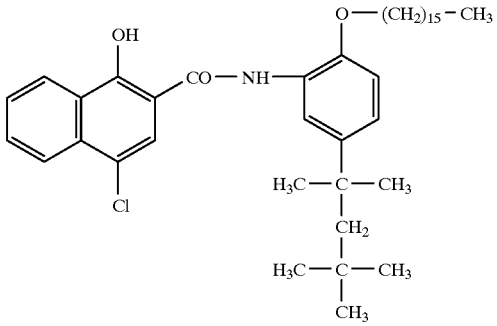

CC-6

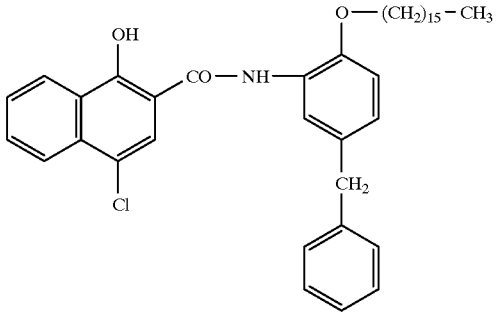

CC-7

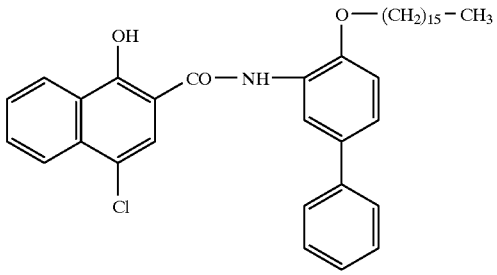

-continued
CC-8
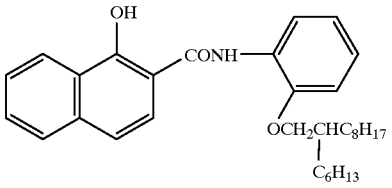
CC-9
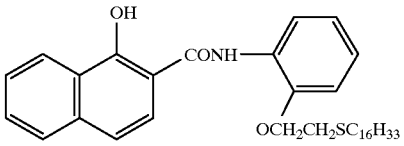
CC-10
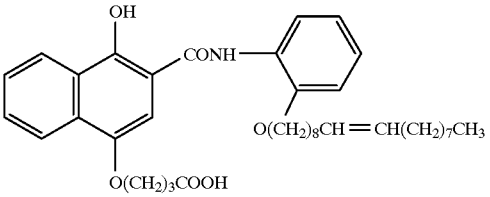
CC-11
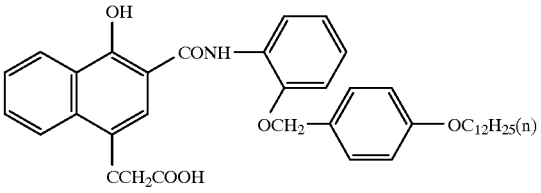
CC-12
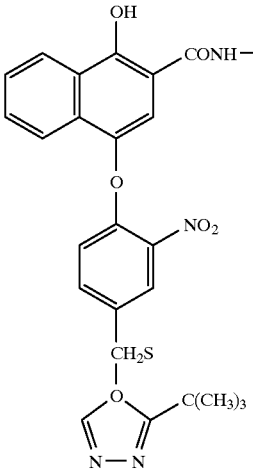
-continued
CC-13
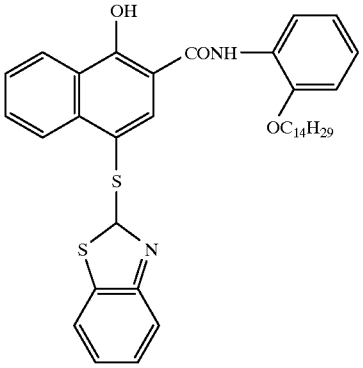
CC-14
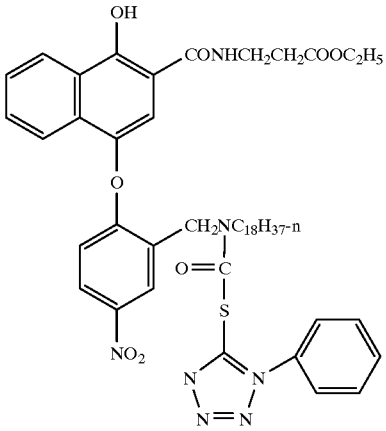
CC-15
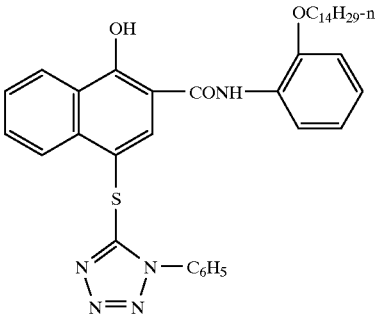

-continued

CC-16

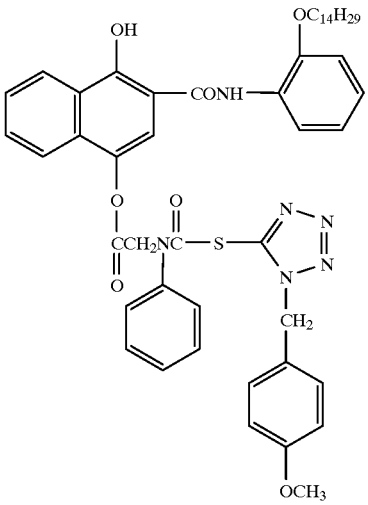

CC-17

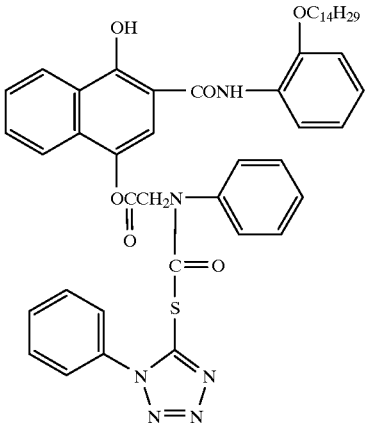

CC-18

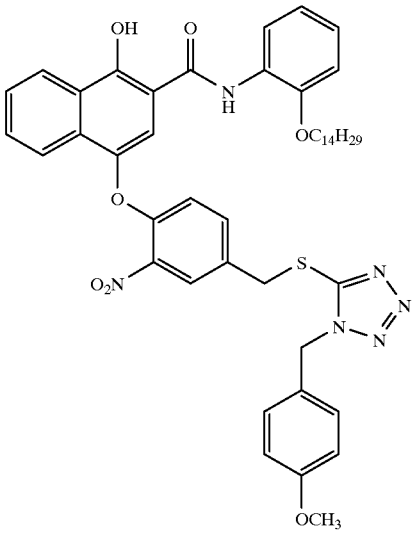

-continued

CC-19

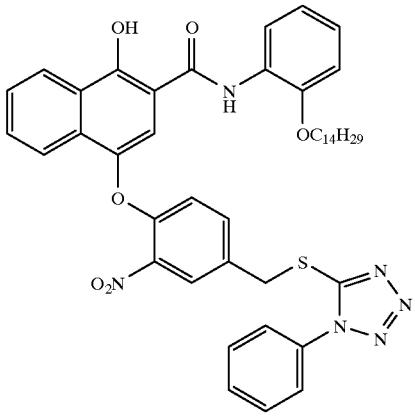

CC-20

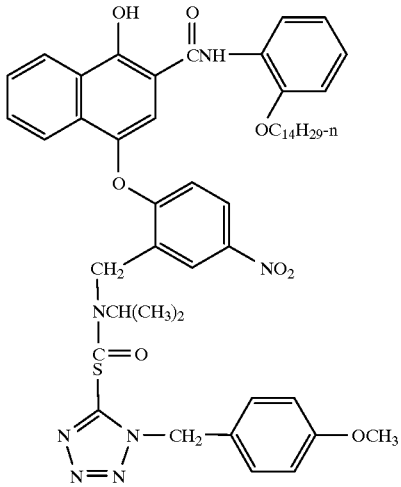

CC-21

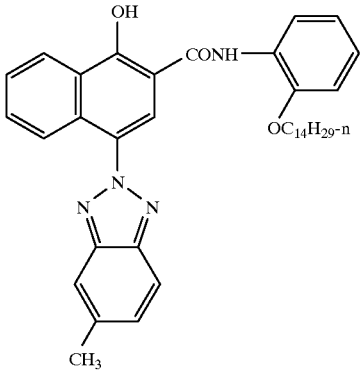

The colorless cyan dye-forming 2-(alkoxyphenylcarbamoyl)-1-naphthol couplers present in the fast red recording emulsion layer are present in conventional concentrations useful for creating a cyan dye image in the absence of any other coupler, even though one or more other couplers, such as colorless PUG releasing couplers or colored masking couplers may also be present in conventional concentrations. The colorless cyan dye-forming 2-(alkoxyphenylcarbamoyl)-1-naphthol couplers are present in a concentration of at least 0.1 mole per mole of radiation-sensitive AgIBr emulsion, based on Ag, and their concentrations can range up to any conventional maximum level, typically up 1 mole per Ag mole. Typically the colorless cyan dye-forming 2-(alkoxyphenylcarbamoyl)-1-naphthol couplers present in fast red recording emulsion layer in a concentration in the range of from 0.2 to 0.8 mole per Ag mole.

Conventionally the fast and slow red recording emulsion layers typically contain at least 1 g/m$^2$ Ag, typically from 1.2 to 3.6 g/m$^2$ Ag. The Ag can be distributed in any conventional manner between or among the fast and slow red recording emulsion layers. It is preferred to incorporate in the fast red recording emulsion layer at least 10 percent of the total silver forming the fast and slow red recording emulsion layers, in both double-coated and triple-coated formats. The fast red recording emulsion layer can contain up to 40 percent of the total silver in the red recording emulsion layers. It is preferred to locate less than 30 (most preferably less than 25) percent of the total silver in the red recording emulsion layers in fast red recording layer. In the layer arrangement of the type shown in CNF-IV above, advantageous improvements in the cyan dye image structure are realized when the fast red recording emulsion layer contains the preferred proportions of total silver.

Subject to the silver distribution indicated above, the slow red recording emulsion layer or layers can take any convenient conventional form. They can, for example, employ any conventional colorless cyan dye-forming coupler, including, but not limited to a colorless cyan dye-forming 2-(alkoxyphenylcarbamoyl)-1-naphthol coupler.

In addition to the colorless cyan dye-forming couplers, it is contemplated, but not required to incorporate conventional levels of colored masking couplers in the red recording emulsion layers.

Apart from the features of the red recording emulsion layers essential to the invention noted above, the color negative films of the invention can take any convenient conventional form. The invention is generally compatible with any color negative film construction that double coats or triple coats the red recording emulsion layers. For example, any of the double coated color negative film constructions CNF-II, CNF-III or CNF-IV or their triple coated counterparts satisfying the red recording emulsion layer requirements stated above can be employed in the process of the invention.

When the red recording emulsion layers are double coated or triple coated, it is conventional practice to also double coat or triple coat the green recording emulsion layers. Since at least the fast green recording emulsion layer is coated to receive exposing radiation prior to the red recording emulsion layers, less silver is typically required. Conventionally the fast and slow green recording emulsion layers typically contain at least 1 g/m$^2$ Ag, typically from 1.0 to 2.8 g/m$^2$ Ag. The Ag can be distributed in any conventional manner between or among the fast and slow green recording emulsion layers. It is preferred to incorporate in the fast green recording emulsion layer at least 20 (preferably 30) percent of the total silver forming the fast and slow green recording emulsion layers, in both double-coated and triple-coated formats. The fast green recording emulsion layer can contain up to 50 percent of the total silver in the green recording emulsion layers. It is preferred to locate from 60 to 80 (preferably 70) percent of the total silver in the green recording emulsion layers in the slow emulsion layer or layers. In the layer arrangement of the type shown in CNF-IV above, advantageous improvements in the magenta dye image structure are realized when the fast green recording emulsion layer contains the preferred proportions of total silver.

The color negative films of the invention can contain one or more blue recording emulsion layers. Although the blue recording emulsion layers can be triple coated, it is common to satisfy image structure with double coated blue recording emulsion layers, even when the green and red recording emulsion layers are triple coated. Since the blue recording emulsion layers are in the most favored position for receiving exposing radiation and the eye receives on average only 10% of its information from the blue record, much less silver can be coated in the blue recording emulsion layer or layers than in the green or red recording emulsion layers. Total silver coating coverages in the blue recording emulsion layers typically range from 0.5 (preferably 0.7) to 2.0 g/m$^2$.

Except for the features previously noted, the construction of the color negative films of the invention can take any convenient conventional form. Color negative films contain transparent film supports to facilitate exposure of a color print element through the color negative image in the film. The support can be either colorless or tinted. Details of film support construction are well understood in the art. Transparent film supports, including subbing layers to enhance adhesion are disclosed in *Research Disclosure*, Item 38957, cited above, XV. Supports.

All of the layers coated on the support in the layer arrangements described above are intended to be penetrated by processing solutions. Thus, these layers are all constructed employing hydrophilic colloid, such as gelatin or gelatin derivatives, as a vehicle. Hydrophilic colloid vehicles (including peptizers and binders) as well as vehicle extenders, such as latices, hydrophilic colloid modifiers (e.g., hardeners) as well as other related addenda are disclosed in *Research Disclosure*, Item 38957, II. Vehicles, vehicle extenders, vehicle-like addenda and vehicle related addenda.

The antihalation layers AHL are optional, but preferred to increase image sharpness. Instead of placing AHL between a red recording layer unit and the transparent film support as shown, it is also well known to place the antihalation layer on the back side of the support. As shown above, AHL in this instance is repositioned below the transparent film support. The antihalation layer contains a dye that can be decolorized in processing. In other words, AHL absorbs light during imagewise exposure, but is rendered colorless prior to printing. If AHL leaves any residual stain, this can be compensated for by adjusting the light source used in printing. Useful antihalation dyes and their decolorization are illustrated by *Research Disclosure*, Item 38957, XIII. Absorbing and scattering materials, B. Absorbing materials and C. Discharge.

The interlayers IL as well as YFL separate recording layer units that are responsive to different regions of the spectrum. An oxidized developing agent scavenger (also sometimes referred to as an antistain agent) is preferably positioned in IL and YFL to reduce or eliminate color contamination resulting from the migration of oxidized developing agent between recording layer units. Oxidized developing agent scavengers are disclosed in *Research Disclosure*, Item 38957, X. Dye image formers and modifiers, D. Hue modifiers/stabilization, paragraph (2).

The yellow filter layer YFL additionally contains either Carey Lea silver, which is removed during bleaching and fixing, or a yellow dye that can be decolorized during processing. Suitable yellow filter dyes are included among the dyes disclosed in *Research Disclosure*, Item 38957, B. Absorbing materials, cited above.

Each of the blue, green and red recording layer units contain radiation-sensitive silver iodobromide emulsions. The grains contain at least 0.1 (preferably at least 0.5) mole percent iodide, based on silver, to increase photographic speed in relation to mean ECD and hence granularity. Higher iodide concentrations are commonly employed in arriving at non-uniform iodide distributions that make further contributions in imaging speed. However, overall iodide concentrations are commonly elevated to improve imaging properties (e.g., to achieve interimage effects). Iodide concentrations up to the saturation level of iodide ion in a silver bromide crystal lattice structure are contemplated, typically about 40 mole percent, depending upon the exact conditions of grain precipitation. It is usually preferred to limit iodide concentrations to less than 15 (most preferably <10 and optimally <5) mole percent, based on silver.

The grains of the silver iodobromide emulsions can be either regular or irregular (e.g., tabular). In the blue recording layer unit the native blue sensitivity of the AgIBr grains can be relied upon to capture exposing radiation. When a blue absorbing spectral sensitizing dye is adsorbed to the surface of the grains, blue light absorption is increased. Both tabular and nontabular grain AgIBr emulsions are commonly employed in blue recording layer units.

Tabular grain emulsions, those in which tabular grains account for at least 50 (preferably at least 70 and optimally at least 90) percent of total grain projected area are particularly advantageous for increasing speed in relation to granularity in the green or red spectrally sensitized emulsions employed in green and red recording layer units. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

Illustrations of conventional radiation-sensitive silver halide emulsions, including both tabular and nontabular grain AgIBr emulsions, are provided by *Research Disclosure*, Item 38957, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

The blue recording layer unit contains at least one yellow dye-forming coupler. Each green recording layer unit contains at least one magenta dye-forming coupler, and each red recording layer unit contains at least one cyan dye-forming coupler. Although the fast red recording emulsion layer requires a colorless 2-(alkoxyphenylcarbamoyl)-1-naphthol cyan dye-forming coupler as stated above, after this requirement has been met, the remaining dye-forming couplers can be chosen from among any convenient combination of conventional dye image-forming couplers. Conventional dye image-forming couplers are illustrated by *Research Disclosure*, Item 38957, cited above, X. Dye image formers and modifiers, B. Image-dye-forming couplers. Dye-forming couplers that combine with oxidized developer to produce cyan colored dyes are listed in paragraph (4). Dye-forming couplers that combine with oxidized developer to produce magenta colored dyes are listed in paragraph (5). Dye-forming couplers that combine with oxidized developer to produce yellow colored dyes are listed in paragraph (6). Compounds that are used with dye-forming couplers to modify the dye image, which are themselves often (but not always) dye-forming couplers, are disclosed in *Research Disclosure*, Item 13857, X. Dye image formers and modifiers, C. Image dye modifiers and D. Hue modifiers/stabilization. Techniques for dispersing dye-forming couplers and image dye modifiers are disclosed in E. Dispersing dyes and dye precursors.

Since dye-forming couplers often produce image dyes that exhibit significant absorption outside of the desired region of the spectrum, it is common practice to incorporate masking dyes, including colored masking couplers, in color negative films. The masking couplers are incorporated with the dye image-forming couplers in the recording layer units. Preformed masking dyes that remain invariant in hue during processing can be incorporated in the recording layer units or in any other layer that does not interfere with imagewise exposure—e.g., in the antihalation layer. Masking dyes, including colored masking couplers, are disclosed in *Research Disclosure*, Item 38957, XII. Features applicable only to color negative, particularly paragraphs (1) and (2).

The surface overcoats OC are hydrophilic colloid layers that are provided for physical protection of the color negative elements during handling and processing. Each OC also provides a convenient location for incorporation of addenda that are most effective at or near the surface of the color negative element. In some instances the surface overcoat is divided into a surface layer and an interlayer, the latter functioning as a spacer between the addenda in the surface layer and the adjacent recording layer unit. In another common variant form, addenda are distributed between the surface layer and the interlayer, with the latter containing addenda that are compatible with the adjacent recording layer unit. Most typically OC contains addenda, such as coating aids, plasticizers and lubricants, antistats and matting agents, such as illustrated by *Research Disclosure*, Item 38957, IX. Coating physical property modifying addenda. It is also common practice to coat an overcoat layer on the back side of the support to locate some or all of the physical property modifying addenda also adjacent to the back surface of the film. The overcoat layers overlying the emulsion layers additionally preferably contain an ultraviolet absorber, such as illustrated by *Research Disclosure*, Item 38957, VI. UV dyes/optical brighteners/luminescent dyes, paragraph (1).

The color negative films of the invention can be imagewise exposed in any convenient conventional manner. The color negative films are specifically contemplated for use as camera speed films having ISO ratings of from 10 to 2000, most commonly from ISO 100 to ISO 1000. They can be color balanced for exposure under tungsten illumination, for daylight exposure or for flash exposure.

Following imagewise exposure photographic processing can be undertaken to produce internal yellow, magenta and cyan negative dye images useful for printing a viewable color positive image. In a preferred form it is contemplated to modify the Kodak Flexicolor™ C-41 process described above by reducing development times to 2 minutes or less. Development times of 90" are demonstrated in the Examples below, and development times of 30" or less are considered feasible. Apart from the required modifications of the color negative films described above, the reduction in development time from 3' 15" to 2' or less can be accomplished while retaining good image qualities by increasing the temperature of the development step. Development temperatures of up to about 80° C. are contemplated. It is also possible to modify the developer composition to increase its activity, thereby contributing to shorter processing times. Further, it is possible to adjust dye-forming coupler concentrations and activity levels in the color negative films to allow for more rapid development. Development temperatures of from 40 to 60° C. are preferred for accelerated development, most preferably in combination with one or more of the optional color negative film adjustments of the type described above.

Although the color negative films of the invention are specifically contemplated for use in a shortened development step form of the Kodak Flexicolor™ C-41, demonstrated in the Examples below, it is appreciated that useful color negative images can be obtained in a wide variety of processing compositions and under a variety of processing conditions. For example, color negative elements satisfying the requirements of the invention can be processed in 2' or less in similarly modified commercial color negative processes, such as the Kodacolor C-22™ process, the Agfacolor processes described in British *Journal of Photography Annual,* 1977, pp. 201–205, and 1988, pp. 196–198, Kodak motion picture processes ECN-2, ECN-2a and ECN-2b.

In color negative processing the first and only absolutely essential step to creating the internal yellow, magenta and cyan dye image structure sought is the step of color development. Color developing solutions typically contain a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, and 2-hydroxy-3-amino-1,4-dimethylbenzene.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include: N,N-diethyl-p-phenylenediamonohydrochloride, 4-N,N-diethyl-2-methylphenylenediamine monohydrochloride, 4-(N-ethyl)-N-2-methanesulfonylaminoethyl)-2-methylphenylenediamine sesquisulfate monohydrate and 4-(N-ethyl-N-2-hydroxyethyl)-2-methylphenylenediamine sulfate.

In addition to the primary aromatic amino color developing agent, color developing solutions typically contain a variety of other agents, such as alkali hydroxides to control pH, halides (e.g., bromides and/or iodides), benzyl alcohol, antioxidants, antifoggants, solubilizing agents, and brightening agents. Useful developer addenda are disclosed in *Research Disclosure*, Item 38957, XIX. Development, except that only color developing agents are useful.

Color developing compositions are employed in the form of aqueous alkaline working solutions having a pH of above 7 and typically in the range of from 9 to 13. To provide the necessary pH, the solutions contain one or more of the well known and widely used buffering agents, such as the alkali metal carbonates or phosphates. Potassium carbonate is especially useful as a buffering agent for color developing compositions.

Once the color negative dye images are obtained by development it is conventional practice to reconvert developed silver to silver halide by bleaching and then to remove the silver halide by fixing. Removal of the silver image removes the neutral silver density that is superimposed on the image dye density thereby constituting a hindrance to printing. Removal of the silver halide by fixing is undertaken to allow the developed color negative element to be handled in room light without printout (that is, without reduction of the remaining silver halide to silver) which objectionably increases minimum densities of each of the dye images. Bleaching and fixing can both be accomplished in a single bleach-fix (a.k.a., blix) solution, if desired. It is common practice to use a stop bath, such as dilute acetic acid, to lower pH and terminate color development. Usually washing or rinsing steps are conducted between development and bleaching and, where separate bleach and fix solutions are employed, between the bleaching and fixing step. A washing step is also commonly used after fixing.

*Research Disclosure*, Item 38957, XX. Desilvering, washing, rinsing and stabilizing, discloses bleaching solutions, fixing solutions, bleach-fixing solutions, and washing, rinsing and stabilizing solutions that can be used in the photographic processing of the invention.

EXAMPLES

The invention can be better appreciated by reference to the following specific embodiments.

Example 1

Preparation of Dispersion of C-12

Compound C-12 in the amount of 300.0 grams was dissolved in 300.0 grams of di-n-butyl phthalate at 140° C. and then added to an aqueous solution of 450.0 grams of gelatin, 300.0 grams of a 10% solution of the surfactant Alkanol-XC™ (DuPont), 8.0 grams of a 0.7% solution of the biocide Kathon LX™ (Rohm & Haas), and 3642.0 grams of distilled water. This mixture was blended using a Silverson™ mixer for 5 minutes at 5000 rpm, then passed through a Crepaco™ homogenizer one time at 5000 psi (34,475 KPa) to provide a dispersion consisting of 6.0% coupler and 9.0% gelatin.

Example 2

Comparison of Multilayer Films at Normal Processing Conditions

The multilayer film structures utilized for the example are shown schematically for Films A and B in Tables I and II respectively. Gelatin was used as a binder in the various film layers.

TABLE I

| Multilayer Film A Structure | |
|---|---|
| Overcoat Layer | Matte Beads |
| | UV Absorber UV-7 (0.108) & S-9 (0.108) |
| | UV Absorber UV-8 (0.108) & S-9 (0.108) |
| | Silver Bromide Lippmann Emulsion (0.215) |
| | Gelatin (0.70) |
| | Bis(vinylsulfonyl)methane Hardener (at 1.8% by weight of total gelatin) |
| Fast Yellow Layer | Y-15 (0.108) & S-2 (0.108) |
| | Y-14 (0.183) & S-2 (0.092) |
| | D-3 (0.097) & S-2 (0.097) |
| | C-22 (0.005) (BARC) & S-3 (0.005) |
| | Blue Sensitized Silver Iodobromide Emulsion (0.592 Ag) |
| | 4.1 mole % Iodide T-Grain ™ (ECD 2.6 μm, t 0.134 |
| | Gelatin (1.53) |

TABLE I-continued

| Multilayer Film A Structure | |
|---|---|
| Slow Yellow Layer | Y-15 (0.430) & S-2 (0.430)<br>Y-14 (0.484) & S-2 (0.242)<br>D-3 (0.086) & S-2 (0.086)<br>C-22 (0.011) (BARC) & S-3 (0.011)<br>Blue Sensitized Silver Iodobromide Emulsion (0.108 Ag)<br>4.1 mole % Iodide T-Grain™ (ECD 1.3 μm, t 0.13 μm)<br>Blue Sensitized Silver Iodobromide Emulsion (0.108 Ag)<br>1.5 mole % Iodide T-Grain ™ (ECD 1.0 μm × 0.13<br>Blue Sensitized Silver Iodobromide Emulsion (0.108 Ag)<br>1.3 mole % Iodide T-Grain ™ (ECD 0.54 μm, t 0.084<br>Gelatin (1.95) |
| Interlayer | Dye-4 Filter Dye (0.108)<br>ST-4 (0.086) & S-2 (0.139)<br>Gelatin (0.646) |
| Fast Magenta Layer | M-5 (0.032) Magenta Dye Forming Coupler & S-1 (0.026) & ST-5 (0.006) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Mid Magenta Layer | M-5 (0.161) & S-1 (0.129) & ST-5 Addendum (0.032)<br>MC-2 (0.065) Masking Coupler & S-1 (0.129)<br>D-4 (0.043) & S-1 (0.043)<br>Green Sensitized Silver Iodobromide Emulsion (0.699 Ag)<br>4.1 mole % Iodide T-Grain ™ (ECD 1.05 μm, t 0.115 μm)<br>Gelatin (0.850) |
| Slow Magenta Layer | M-5 (0.377) & S-1 (0.301) & ST-5 Addendum (0.076)<br>MC-2 (0.065) Masking Coupler & S-1 (0.129)<br>Green Sensitized Silver Iodobromide Emulsion (0.161 Ag)<br>2.6 mole % Iodide T-Grain ™ (ECD 0.75 μm, t 0.115 μm)<br>Green Sensitized Silver Iodobromide Emulsion (0.054 Ag)<br>1.3 mole % Iodide T-Grain ™ (ECD 0.54 μm, t 0.084<br>Gelatin (0.990) |
| Interlayer | ST-4 Oxidized Developer Scavenger (0.075) & S-2 (0.122)<br>Gelatin (0.430) |
| Fast Cyan Layer | C-2 (0.161) Cyan Dye-Forming Coupler & S-2 (0.161)<br>B-1 (0.030)DIAR & N-n-Butylacetanilide (0.060)<br>Ag)<br>1.3 mole % Iodide T-Grain ™ (ECD 0.54 μm, t 0.084<br>Gelatin (1.95) |
| Interlayer | Dye-4 Filter Dye (0.108)<br>ST-4 (0.086) & S-2 (0.139)<br>Gelatin (0.646) |
| Fast Magenta Layer | M-5 (0.032) Magenta Dye Forming Coupler & S-1 (0.026) & ST-5 (0.006) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (ECD 1.25 μm, t 0.12<br>Gelatin (0.742) |
| Mid Magenta Layer | M-5 (0.161) & S-1 (0.129) & ST-5 Addendum (0.032)<br>MC-2 (0.065) Masking Coupler & S-1 (0.129)<br>D-4 (0.043) & S-1 (0.043)<br>Green Sensitized Silver Iodobromide Emulsion (0.699 Ag)<br>4.1 mole % Iodide T-Grain ™ (ECD 1.05 μm, t 0.115 μm)<br>Gelatin (0.850) |
| Slow Magenta Layer | M-5 (0.377) & S-1 (0.301) & ST-5 Addendum (0.076)<br>MC-2 (0.065) Masking Coupler & S-1 (0.129)<br>Green Sensitized Silver Iodobromide Emulsion (0.161 Ag)<br>2.6 mole % Iodide T-Grain ™ (ECD 0.75 μm, t 0.115 μm) |

TABLE I-continued

| Multilayer Film A Structure | |
|---|---|
| | Green Sensitized Silver Iodobromide Emulsion (0.054 Ag)<br>1.3 mole % Iodide T-Grain ™ (ECD 0.54 μm, t 0.084<br>Gelatin (0.990) |
| Interlayer | ST-4 Oxidized Developer Scavenger (0.075) & S-2 (0.122)<br>Gelatin (0.430) |
| Fast Cyan Layer | C-2 (0.161) Cyan Dye-Forming Coupler & S-2 (0.161)<br>B-1 (0.030)DIAR & N-n-Butylacetanilide (0.060)<br>D-5 (0.048) DIR & S-1 (0.194)<br>MC-1 (0.032) Masking Coupler<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Mid Cyan Layer | C-2 (0.355) & S-2 (0.355)<br>C-2 (0.019) & B-1 (0.019) & S-2 (0.039)<br>C-22 (0.008) & S-3 (0.008)<br>MC-1 (0.032)<br>Red Sensitized Silver Iodobromide Emulsion (0.721 Ag)<br>4.1 mole % Iodide T-Grain ™ (ECD 1.05, t 0.115 μm)<br>Gelatin (1.12) |
| Slow Cyan Layer | C-2 (0.538) & S-2 (0.0538)<br>C-2 (0.008) & B-1 (0.008) & S-2 (0.016)<br>C-22 (0.056) & S-3 (0.056)<br>Y-15 (0.065) & S-2 (0.065)<br>Red Sensitized Silver Iodobromide Emulsion (0.248 Ag)<br>4.1 mole % Iodide T-Grain ™ (ECD 0.73, t 0.12 μm)<br>Red Sensitized Silver Iodobromide Emulsion (0.237 Ag)<br>1.3 mole % Iodide T-Grain ™ (ECD 0.54, t 0.084 μm)<br>Gelatin (1.36) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin(1.61)<br>Cellulose Triacetate Support |

TABLE II

| Multilayer Film B Structure | |
|---|---|
| Overcoat Layer | Same as Film A |
| Fast Yellow Layer | Same as Film A |
| Slow Yellow Layer | Same as Film A |
| Interlayer | Same as Film A |
| Fast Magenta Layer | Same as Film A |
| Mid Magenta Layer | Same as Film A |
| Slow Magenta Layer | Same as Film A |
| Interlayer | Same as Film A |
| Fast Cyan Layer | C-12 (0.054) Cyan Dye Forming Coupler & S-2 (0.054)<br>B-1 (0.030) DIAR & N-n-Butylacetanilide (0.060)<br>D-5 (0.048) DIR & S-1 (0.194)<br>MC-1 (0.032) Masking Coupler<br>Red Sensitized Silver Iodobromide Emulsion (0.430 Ag)<br>4.1 mole % Iodide T-Grain ™ (BCD 1.25 μm, t 0.12 μm)<br>Gelatin (0.807) |
| Mid Cyan Layer | Same as Film A |
| Slow Cyan Layer | Same as Film A |
| Antihalation Layer | Same as Film A<br>Cellulose Triacetate Support |

Both films were exposed through a step tablet on an Eastman™ 1B sensitometer and processed through the KODAK FLEXICOLOR™ C-41 process described below. The step tablet was divided into 21 density steps, with step 1 having density of 4 and step 21 having a density of zero.

TABLE III

C-41 Processing Solutions and Conditions

| Solution | Agitation | Processing Time | Temperature |
|---|---|---|---|
| Developer | Nitrogen Burst | 3'15" | 37.8 C. |
| Fresh Bleach II | Continuous Air | 4' | 37.8 C. |
| Wash | Continuous Air | 3' | 35.5 C. |
| Fix | Continuous Air | 4' | 37.8 C. |
| Wash | Continuous Air | 3' | 35.5 C. |
| PHOTO-FLO ™ | None | 1' | 37.8 C. |

The Status M densities of the processed films were then measured via a densitometer and density vs Log exposure curves were plotted and measured. The red and green inertial speeds were measured at densities=Dmin+0.15 for each color. The red and green gammas were measured via a least squares fit to the sensitometric curves. The speeds and gammas for Films A and B in the standard C-41 process of Table III are compared in Table IV below:

TABLE IV

Sensitometric Comparison of Films A & B in Normal C-41 Process

| | | Relative Speed | | | Gamma | | |
|---|---|---|---|---|---|---|---|
| Film | TOD* | Red | Green | Blue | Red | Green | Blue |
| A | 3'15" | 321 | 328 | 353 | 0.57 | 0.64 | 0.64 |
| B | 3'15" | 327 | 328 | 355 | 0.56 | 0.62 | 0.64 |

*Time of development

Table IV indicates that Films A and B have gammas within 5% of each other, but Film B shows a significant increase in red speed (+0.06 log E) over Film A. The step tablet exposures for the two films were also measured for granularity using a densitometer with a 48 $\mu$m aperture. The raw granularity values (Sd×1000) for each film at several log exposure steps which encompass the normal exposure range for these films are recorded and compared in Table V below. Assuming that a 5% difference in Sd=1 grain unit, grain unit differences for the red records for the two films were calculated and listed in Table V.

TABLE V

Granularity Comparison for Films A & B in Normal C-41 Process

| | | | Sd × 1000 at Exposure Step | | | | |
|---|---|---|---|---|---|---|---|
| Film | TOD | Color | 15 | 13 | 11 | 2 | 7 |
| A | 3'15" | Red | 11.33 | 12.60 | 12.30 | 11.00 | 10.00 |
| B | 3'15" | Red | 13.95 | 13.13 | 11.96 | 10.18 | 9.43 |
| Diff. in Grain Units = | | | +4.3 | +0.8 | −0.6 | −1.6 | −1.2 |

Film B shows the expected red grain penalty in the lower scale due to its increased red speed.

Example 3

Comparison of Multilayer Films at Rapid Processing Conditions

The multilayer film structures utilized for this example are shown schematically for Films C and D Tables VI, VII, respectively. Gelatin was used as a binder in the various film layers.

TABLE VI

Multilayer Film C Structure

| | |
|---|---|
| Overcoat Layer | Same as Film A |
| Fast Yellow Layer | Y-15 (0.215) & S-2 (0.215)<br>Y-14 (0.183) & S-2 (0.092)<br>D-3 (0.097) & S-2 (0.097)<br>C-22 (0.005) (BARC) & S-3 (0.005)<br>Blue Sensitized Silver Iodobromide Bmulsion (0.592 Ag)<br>4.1 mole % Iodide T-Grain ™ (ECD 2.6 $\mu$m, t 0.134 $\mu$m)<br>Gelatin (1.53) |
| Slow Yellow Layer | Y-15 (0.323) & S-2 (0.323)<br>Y-14 (0.484) & S-2 (0.242)<br>D-3 (0.086) & S-2 (0.086)<br>C-22 (0.01 1) (BARC) & S-3 (0.011)<br>Blue Sensitized Silver Iodobromide Emulsion (0.108 Ag)<br>4.1 mole % Iodide T-Grain ™ (ECD 1.3 $\mu$m, t 0.13 $\mu$m)<br>Blue Sensitized Silver Iodobromide Emulsion (0.215 Ag)<br>1.5 mole % Iodide T-Grain ™ (ECD 1.0 $\mu$m, t 0.13 $\mu$m)<br>Blue Sensitized Silver Iodobromide Emulsion (0.161 Ag)<br>1.3 mole % Iodide T-Grain ™ (ECD 0.54 $\mu$m, t 0.084<br>Gelatin (1.95) |
| Interlayer | Same as Film A |
| Fast Magenta Layer | M-5 (0.108) Magenta Dye Forming Coupler & S-1 (0.086) & ST-5 (0.022) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (ECD 1.25 $\mu$m, t 0.12<br>Gelatin (0.742) |
| Mid Magenta Layer | M-5 (0.538) & S-1 (0.430) & ST-5 Addendum (0.108)<br>MC-2 (0.065) Masking Coupler & S-1 (0.129)<br>D-4 (0.043) & S-1 (0.043)<br>Green Sensitized Silver Iodobromide Emulsion (0.538 |

TABLE VI-continued

| Multilayer Film C Structure | |
|---|---|
| | Ag) |
| | 4.1 mole % Iodide T-Grain ™ (ECD 1.05 μm, t 0.115 |
| | Gelatin (0.850) |
| Slow Magenta Layer | M-5 (0.215) & S-1 (0.172) & ST-5 Addendum (0.043) |
| | MC-2 (0.065) Masking Coupler & S-1 (0.129) |
| | Green Sensitized Silver Iodobromide Emulsion (0.753 Ag) |
| | 2.6 mole % Iodide T-Grain ™ (ECD 0.75 μm, t 0.115 μm) |
| | Green Sensitized Silver Iodobromide Emulsion (0.161 Ag) |
| | 1.3 mole % Iodide T-Grain ™ (ECD 0.54 μm, t 0.084 |
| | Gelatin (0.990) |
| Interlayer | Same as Film A |
| Fast Cyan Layer | C-2 (1.076) Cyan Dye-Forming Coupler & S-2 (1.076) |
| | B-1 (0.030) DIAR & N-n-Butylacetanilide (0.060) |
| | D-5 (0.048) DIR & S-1 (0.194) |
| | MC-1 (0.032) Masking Coupler |
| | Red Sensitized Silver Iodobromide Emulsion (0.430 Ag) |
| | 4.1 mole % Iodide T-Grain ™ (ECD 1.25 μm, t 0.12 |
| | Gelatin (0.807) |
| Mid Cyan Layer | C-2 (0.377) & S-2 (0.377) |
| | C-2 (0.019) & B-1 (0.019) & S-2 (0.039) |
| | C-22 (0.008) & S-3 (0.008) |
| | MC-1 (0.032) |
| | Red Sensitized Silver Iodobromide Emulsion (0.872 Ag) |
| | 4.1 mole % Iodide T-Grain ™ (ECD 1.05 μm, t 0.115 |
| | Gelatin (1.12) |
| Slow Cyan Layer | C-2 (0.538) & S-2 (0.0538) |
| | C-2 (0.008) & B-1 (0.008) & S-2 (0.016) |
| | C-22 (0.056) & S-3 (0.056) |
| | Y-15 (0.065) & S-2 (0.065) |
| | Red Sensitized Silver Iodobromide Emulsion (0.517 Ag) |
| | 4.1 mole % Iodide T-Grain ™ (ECD 0.73 μm, t 0.12 |
| | Red Sensitized Silver Iodobromide Emulsion (0.828 Ag) |
| | 1.3 mole % Iodide T-Grain ™ (ECD 0.54 μm, t 0.084 |
| | Gelatin (1.36) |
| Antihalation Layer | Same as Film A |
| | Cellulose Triacetate Support |

TABLE VIII

| Multilayer Film D Structure | |
|---|---|
| Overcoat Layer | Same as Film C |
| Fast Yellow Layer | Same as Film C |
| Slow Yellow Layer | Same as Film C |
| Interlayer | Same as Film C |
| Fast Magenta Layer | Same as Film C |
| Mid Magenta Layer | Same as Film C |
| Slow Magenta Layer | Same as Film C |
| Interlayer | Same as Film C |
| Fast Cyan Layer | C-12 (0.646) Cyan Dye Forming Coupler & S-2 (0.646) |
| | B-1 (0.030) DIAR & S-2 (0.060) |
| | D-5 (0.048) DIR & S-1 (0.097) |
| | MC-1 (0.032) Masking Coupler |
| | Red Sensitized Silver Iodobromide Emulsion (0.430 Ag) |
| | 4.1 mole % Iodide T-Grain ™ (ECD 1.25 μm, t 0.12 |
| | Gelatin (0.807) |
| Mid Cyan Layer | Same as Film C |
| Slow Cyan Layer | Same as Film C |
| Antihalation Layer | Same as Film C |
| | Cellulose Triacetate Support |

Films C and D were exposed through a step tablet on a 1B sensitometer and processed through the KODAK FLEXICOLOR™ C-41 process described in Table III above. The Status M densities of the processed films were then measured via a densitometer and density vs log exposure curves were plotted and measured. The red inertial speeds were measured at densities=Dmin+0.15 and the red gammas were measured via a least squares fit to the sensitometric curves. The red speeds and gammas for Films C and D in their respective processes are compared in Table VIII below:

TABLE VIII

| Red Sensitometric Comparison of Films C and D in Rapid C-41 | | | | |
|---|---|---|---|---|
| | Processes | | | |
| Film | Process Time | Process Temp. | Red Speed | Red Gamma |
| C | 90" | 37.8 C. | 265 | 0.53 |
| D | 90" | 37.8 C. | 285 | 0.53 |

Table VIII indicates that Film D which features C-12 in the fast cyan layer shows a substantial increase (+0.20 log E) in red speed in the rapid C-41 process as compared to Film C which features C-2. Based on the sensitometric results of Table IV in Example 2, this red speed increase is much greater than that expected.

Glossary of Acronyms

S-1=Tritolyl phosphate

S-2=Dibutyl phthalate

S-3=N,N-Diethyldodecanamide

S-9=1,4-Cyclohexyldimethylene bis(2-ethylhexanoate)

UV-7

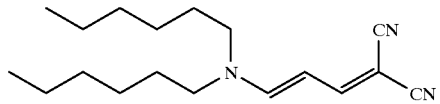

UV-8

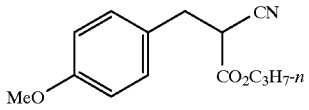

B-1

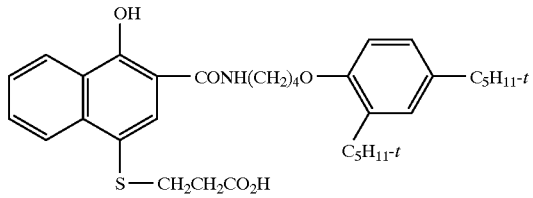

Y-14

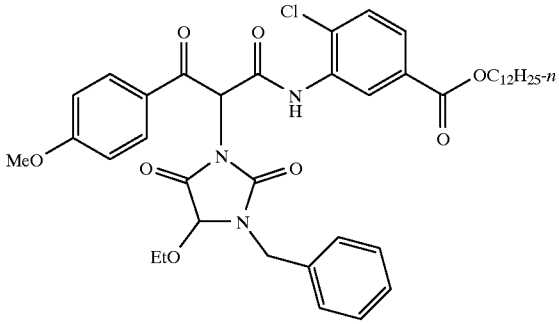

Y-15

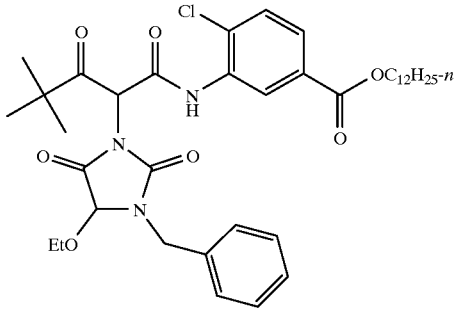

-continued
DYE 4
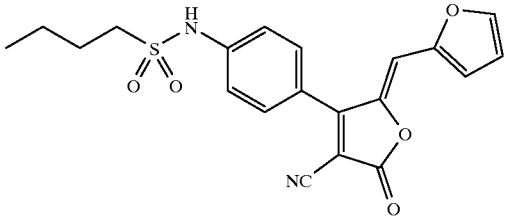
DYE 5
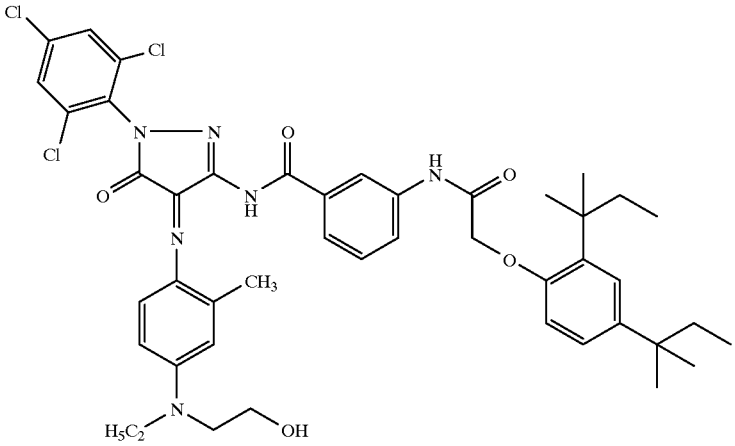
DYE 6
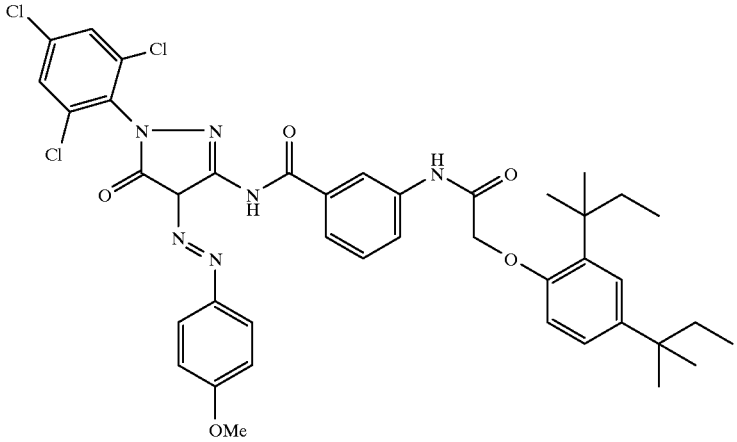
DYE 7
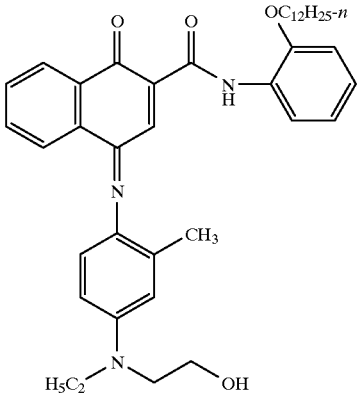

-continued
C-2
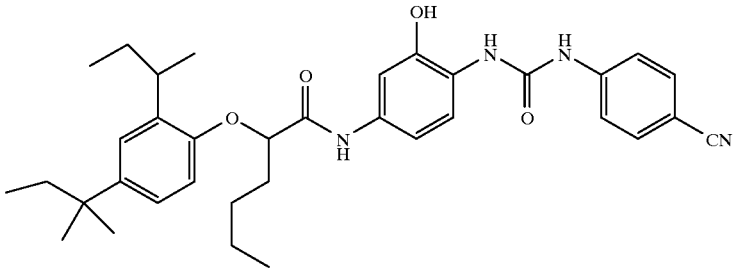
C-12
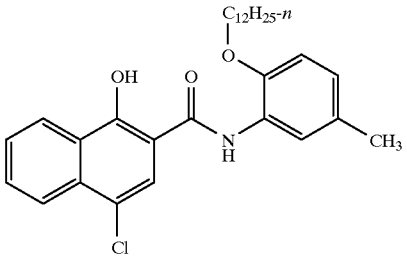
C-22
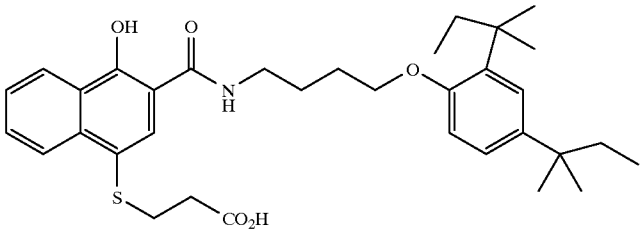
D-3
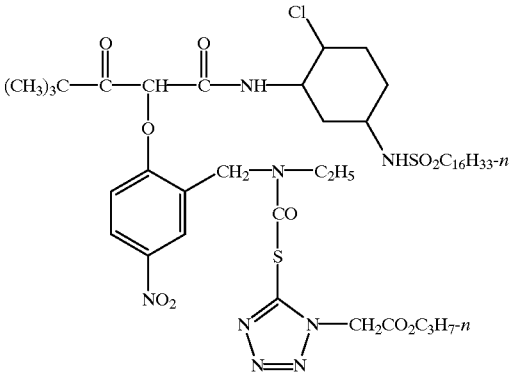
D-4
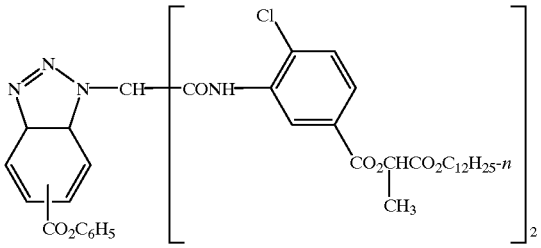

-continued
D-5
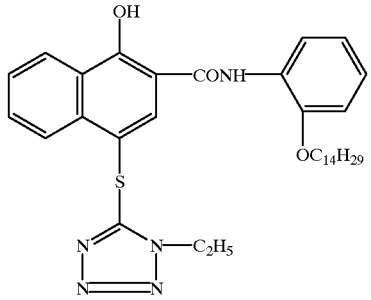
ST-4
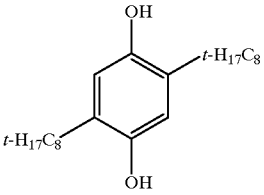
ST-5
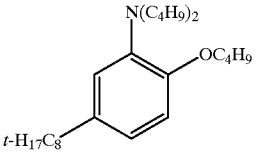
M-5
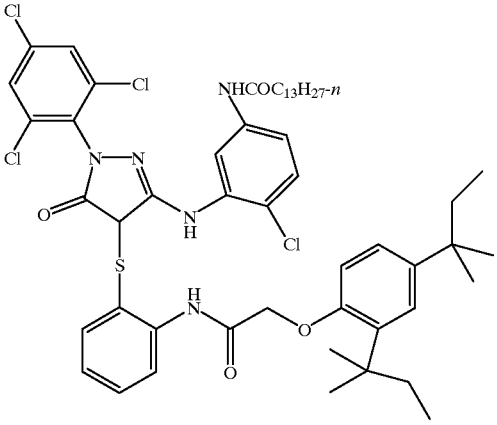

-continued

MC-1

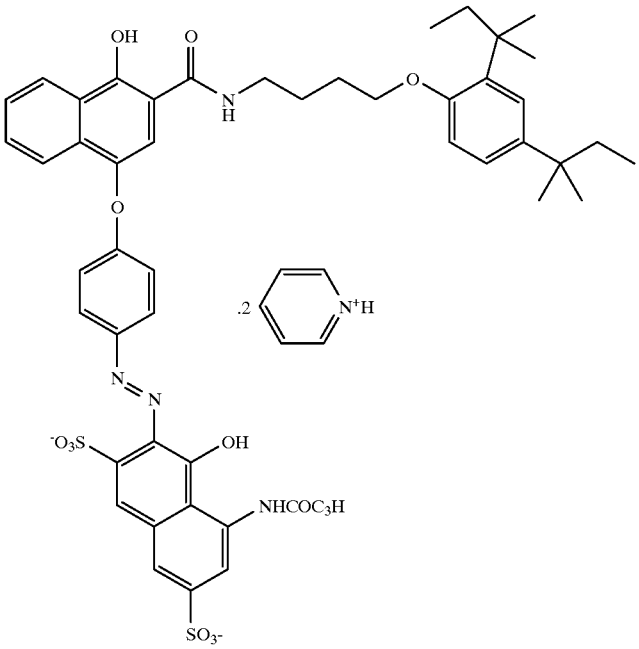

MC-2

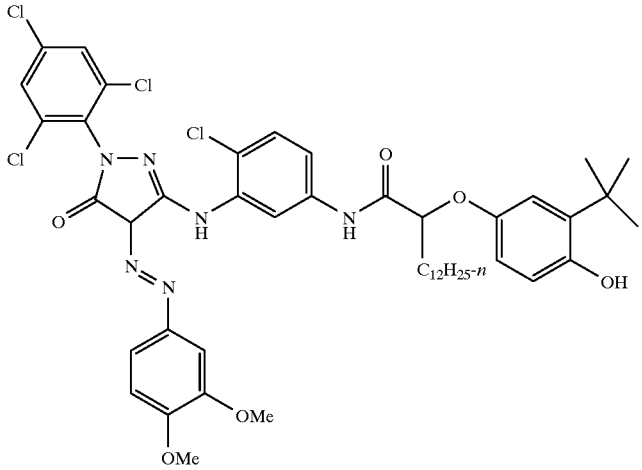

The invention has been described in detail with particular reference to preferred embodiments thereof, but it will be understood that variations and modifications can be effected within the spirit and scope of the invention.

What is claimed is:

1. A process of producing a color negative image comprised of developing an imagewise exposed photographic element to create a silver image and yellow, magenta and cyan dye images, bleaching the silver image, and fixing to remove silver halide, the imagewise exposed photographic element being comprised of a transparent film support and, coated on the support, at least one blue recording silver iodobromide emulsion layer containing yellow dye-forming coupler and located to receive exposing radiation prior to all green and red recording emulsion layers, a yellow filter layer located to receive exposing radiation from the blue recording layer unit, at least two green recording silver iodobromide emulsion layers containing magenta dye-forming coupler and located to receive exposing radiation from the yellow filter layer, including a fast green recording emulsion layer and at least one slow green recording emulsion layer, the fast green recording emulsion layer being located to receive exposing radiation directly from the yellow filter layer, at least two red recording silver iodobromide emulsion layers containing cyan dye-forming coupler, including a fast red recording emulsion layer and at least one slow red recording emulsion layer, the fast red recording emulsion layer being located to receive exposing radiation after at least the fast emulsion layer of the green recording emulsion layers and to be the first red recording emulsion layer to receive exposing radiation,

WHEREIN, development is undertaken in 2 minutes or less and the fast red recording emulsion layer contains in a concentration of at least 0.1 mole per silver mole a colorless cyan dye-forming 2-(alkoxyphenylcarbamoyl)-1-naphthol coupler.

2. A process of producing a color negative image according to claim 1 wherein the fast red recording emulsion layer contains up to 1.0 mole of silver per mole of the colorless cyan dye-forming 2-(alkoxyphenylcarbamoyl)-1-naphthol coupler.

3. A process of producing a color negative image according to claim 2 wherein the fast red recording emulsion layer contains from 0.2 to 0.8 mole of silver per mole of the colorless cyan dye-forming 2-(alkoxyphenylcarbamoyl)-1-naphthol coupler.

4. A process of producing a color negative image according to claim 1 wherein the red recording emulsion layers contain at least 1.8 g/m$^2$ of silver and the fast red recording emulsion layer contains at least 10 percent of the total silver in the red recording emulsion layers.

5. A process of producing a color negative image according to claim 4 wherein the green recording emulsion layers contain at least 1.0 g/m$^2$ of silver and the fast green recording emulsion layer contains at least 20 percent of total silver in the green recording emulsion layers.

6. A process of producing a color negative image according to claim 1 wherein the colorless cyan dye-forming 2-(alkoxyphenylcarbamoyl)-1-naphthol coupler is chosen to satisfy the formula:

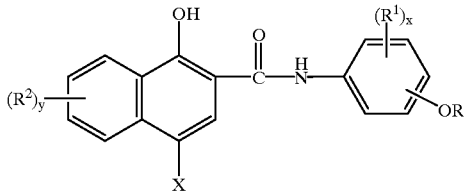

wherein

X, R, $R^1$, $R^2$ and $R^3$ are each free of a dye chromophore and contain less than 32 carbon atoms, R represents a substituted or unsubstituted alkyl group containing at least 6 carbon atoms, $R^1$ and $R^2$ each represents an aromatic ring substituent, X is hydrogen or a coupling off group, and x and y are each an independent integer of from zero to 4.

7. A process of producing a color negative image according to claim 6 wherein R represents a linear alkyl group containing from 8 to 20 carbon atoms and x and y are each an independent integer of zero or 1.

8. A process of producing a color negative image according to claim 7 wherein the colorless cyan dye-forming 2-(alkoxyphenylcarbamoyl)-1-naphthol coupler satisfies the formula:

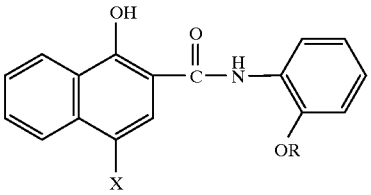

wherein

R is a linear alkyl group of from 8 to 20 carbon atoms and

X is a coupling off group.

9. A process of producing a color negative image according to claim 6 wherein the colorless cyan dye-forming 2-(alkoxyphenylcarbamoyl)-1-naphthol coupler is a mixture of couplers at least one of which contains a coupling off group that on release acts as a photographically useful group.

10. A process of producing a color negative image according to claim 1 wherein the imagewise exposed photographic element is developed in from 30 seconds to 2 minutes.

11. A process of producing a color negative image according to claim 1 wherein development is undertaken at a temperature of from 40 to 60° C.

12. A process of producing a color negative image comprised of developing an imagewise exposed photographic element to create a silver image and yellow, magenta and cyan dye images, bleaching the silver image, and fixing to remove silver halide, the imagewise exposed photographic element being comprised of a transparent film support and, coated on the support, at least one blue recording silver iodobromide emulsion layer containing yellow dye-forming coupler and located to receive exposing radiation prior to all green and red recording emulsion layers, a yellow filter layer located to receive exposing radiation from the blue recording layer unit, at least two green recording silver iodobromide emulsion layers containing magenta dye-forming coupler and located to receive exposing radiation from the yellow filter layer, including a fast green recording emulsion layer and at least one slow green recording emulsion layer, the fast green recording emulsion layer being located to receive exposing radiation directly from the yellow filter layer, at least two red recording silver iodobromide emulsion layers containing cyan dye-forming coupler, including a fast red recording emulsion layer and at least one slow red recording emulsion layer, the fast red recording emulsion layer being located to receive exposing radiation after at least the fast emulsion layer of the green recording emulsion layers and to be the first red recording emulsion layer to receive exposing radiation,

WHEREIN, development is undertaken in from 30 seconds to 2 minutes at temperature of from 40 to 60° C., the fast red recording emulsion layer contains from 0.2 to 0.8 mole of silver per mole of the colorless cyan dye-forming 2-(alkoxyphenylcarbamoyl)-1-naphthol coupler, the red recording emulsion layers contain at least 1.8 g/m$^2$ of silver, and the fast red recording emulsion layer contains at least 10 percent of the total silver in the red recording emulsion layers.

* * * * *